United States Patent [19]

Downing et al.

[11] 4,167,409

[45] Sep. 11, 1979

[54] PROCESS FOR LOWERING THE SULFUR CONTENT OF VANADIUM-CARBON MATERIALS USED AS ADDITIONS TO STEEL

[75] Inventors: James H. Downing, Clarence; Rodney F. Merkert, Buffalo, both of N.Y.

[73] Assignee: Union Carbide Corporation, New York, N.Y.

[21] Appl. No.: 941,403

[22] Filed: Sep. 11, 1978

Related U.S. Application Data

[63] Continuation of Ser. No. 827,074, Aug. 23, 1977, which is a continuation of Ser. No. 700,472, Jun. 28, 1976, abandoned.

[51] Int. Cl.[2] ..... C22B 34/22

[52] U.S. Cl. ..... 75/129; 75/84

[58] Field of Search ..... 75/0.5 BB, 129, 84, 75/257; 423/370, 470

[56] References Cited

U.S. PATENT DOCUMENTS

| | | | |
|---|---|---|---|
| 2,791,501 | 5/1957 | Brennan | 75/129 |
| 2,939,784 | 6/1960 | Brennan | 75/130.5 |
| 3,318,691 | 5/1967 | Jellinghaus | 75/129 |
| 3,334,992 | 8/1967 | Downing | 75/0.5 |
| 3,420,659 | 1/1969 | Rathmann | 75/84 |
| 3,460,937 | 8/1969 | Rathmann | 75/84 |
| 3,567,432 | 3/1971 | Wardell | 75/257 |
| 3,579,328 | 5/1971 | Aas | 75/133.5 |
| 3,591,367 | 7/1971 | Perfect | 75/133 |
| 3,753,681 | 8/1973 | Vojkovic | 75/1 R |
| 3,929,460 | 12/1975 | Peters | 75/24 |
| 3,929,461 | 12/1975 | Miyoshi | 75/24 |
| 4,040,814 | 8/1977 | Merkert | 75/129 |

*Primary Examiner*—P. D. Rosenberg
*Attorney, Agent, or Firm*—Frederick J. McCarthy, Jr.

[57] ABSTRACT

Vanadium-carbon materials for use as additions to steel have been produced by the vacuum furnacing of a mixture of vanadium oxide and carbon. To lower the sulfur content of such material, which derives essentially from the sulfur content of the carbon in the mixture, a relatively small quantity of silicon, silica or tin is included in the mixture prior to vacuum furnacing.

4 Claims, No Drawings

PROCESS FOR LOWERING THE SULFUR CONTENT OF VANADIUM-CARBON MATERIALS USED AS ADDITIONS TO STEEL

This application is a continuation of our prior U.S. application Ser. No. 827,074, filed Aug. 23, 1977 which is a continuation of application Ser. No. 700,472, filed June 28, 1976, now abandoned.

The present invention is directed to a method for lowering the sulfur content in materials containing vanadium and carbon which are produced by the vacuum furnacing of a mixture of vanadium oxide and carbon.

Vanadium-carbon materials of the type noted above are produced by the high temperature vacuum furnacing of vanadium oxide and carbon as described for example in U.S. Pat. No. 3,334,992 -J. H. Downing and R. F. Merkert, the disclosure of this patent being incorporated herein by reference.

The vanadium-carbon materials disclosed in the above-noted patent are produced by a method which includes the steps of mixing of $V_2O_3$ and carbon, compacting the mixture into briquets and vacuum furnacing the mixture at elevated temperatures, e.g. 1200° C. to 1400° C. at a pressure of less than about 300 microns, to produce a product in which is substantially all in the form of combined vanadium and carbon. This material is widely used as a vanadium source addition to molten steel. It has been found that the sulfur content of such vanadium-carbon product is on the order of about $\frac{1}{3}$ sulfur content of the starting mixture of $V_2O_3$ and carbon, the sulfur content of the starting mixture being essentially due to the sulfur content of the carbon source, e.g. coal, carbon black and the like.

Since it is undesirable to add sulfur impurities to steel, it is important to lower the sulfur content of vanadium-carbon materials as described above, particularly when low sulfur carbon materials are not readily available.

It is therefore an object of the present invention to provide a method for lowering the sulfur content of vanadium-carbon materials produced by the vacuum furnacing of a mixture of a vanadium oxide and carbon.

Other objects will be apparent from the following description and claims.

A method in accordance with the present invention comprises including in a mixture of vanadium oxide and carbon which contains sulfur as an impurity, a minor proportion of at least one material selected from the group consisting of silicon, silica and tin, and vacuum furnacing said mixture to provide a material which is substantially all in the form of combined vanadium and carbon, i.e. at least about 80% by weight with the predominant proportion of combined vanadium being in the form of $V_2C$ and the atomic ratio of vanadium to carbon being in the range of 1.49 to 2.42, and which has a sulfur content substantially lower than that of the starting mixture.

In the practice of a particular embodiment of the present invention, a mixture of finely divided $V_2O_3$ and carbon is prepared and at least one of a finely divided material selected from the group of silicon, silica and tin is included in the mixture. The aggregate amount selected material, when the selected material is tin, is from about 1 to 5 times the weight of sulfur in the carbon constituent of mixture. When the selected material is silicon or silica, the aggregate amount of the silicon present is about 1 to 9 times the weight of sulfur in the carbon constituent of the mixture. The mixture is thereafter briquetted and subjected to a temperature in the range of about 1200° C. to 1400° C. in a vacuum furnace wherein the mixture constituents are reacted, and reaction being completed at a pressure of less than about 300 microns; the reaction time being sufficient to cause the carbon and $V_2O_3$ to combine and form a product which is at least 80% by weight in the form of combined vanadium and carbon. The sulfur content of thus produced material will be less than about 0.05% by weight.

The following example will further illustrate the present invention. The mesh sizes in the examples are U.S. Screen Series.

EXAMPLE I (895)

A mix was prepared containing 1000 lbs. of $V_2O_3$ sized $-2\mu$, 335 lbs. of petroleum coke containing 0.65% sulfur sized $-2\mu$, 20 lbs. of Mogul* binder and 23% water based on dry weight. Briquets sized $1\frac{3}{4}'' \times 1\frac{1}{4}'' \times 1''$ were prepared from the mix by pressing in a K-G roll briquet press and drying at 225° F. The resulting briquets, in the amount of 3 lbs., were charged to a vacuum furnace having interior working dimensions of $7'' \times 12'' \times 40''$. The pressure in the furnace was reduced to 175 microns and the furnace was heated to 1400° C. Due to evolution of CO the pressure rose to about 1600 microns. After about 8 hours at 1400° C. The pressure dropped to 100 microns and the furnace contents were then cooled to room temperature under a positive pressure of argon. The product briquets analyzed 8.49% combined carbon and 0.18% sulfur.

*Trademark of Corn Products Company

EXAMPLE II (902)

Essentially the same procedure as in Example I was followed, except that the mix contained 1.7% silicon based on the weight of $V_2O_3$ sized 200 M X D. The resulting briquets contained 7.94% combined carbon and 0.013% sulfur.

EXAMPLE III (903)

Essentially the same procedure as in Example I was followed, except that the mix contained 0.5% tin based on the weight of $V_2O_3$ sized 100 M X D. The resulting briquets contained 7.44% combined carbon and 0.042% sulfur.

EXAMPLE IV (905)

Essentially the same procedure as in Example I was followed, except that the mix contained 3.6% $S_iO_2$ based on the weight of $V_2O_3$ sized 200 M X D. The resulting briquets contained 9.34% combined carbon and 0.012% sulfur.

What is claimed is:

1. In the manufacture of a vanadium and carbon containing material at least about 80% by weight being in the form of combined vanadium and carbon with the predominant proportion of combined vanadium being in the form of $V_2C$ and the atomic ratio of vanadium to carbon being in the range of 1.49 to 2.42, by vacuum furnacing of a mixture of vanadium oxide and a carbon source material containing sulfur, the improvement for lowering the sulfur content of said material which comprises adding to said mixture prior to furnacing thereof at least one material selected from the group consisting of silicon, silica and tin wherein the aggregate amount of silicon and tin is from about 1 to 9 times by weight the amount of sulfur in the carbon constituent in the mixture of vanadium oxide and carbon.

2. A method in accordance with claim 1 wherein said selected material is silicon wherein the amount of said silicon is from about 1 to 9 times by weight the amount of sulfur in the carbon constituent in the mixture of vanadium oxide and carbon.

3. A method in accordance with claim 1 wherein said selected material is silica wherein the amount of silicon present in said silica is from about 1 to 9 times by weight the amount of sulfur in the carbon constituent in the mixture of vanadium oxide and carbon.

4. A method in accordance with claim 1 wherein said selected material is tin wherein the amount of said tin is from about 1 to 5 times by weight the amount of sulfur in the carbon constituent in the mixture of vanadium oxide and carbon.

* * * * *